United States Patent [19]

Ripley

[11] Patent Number: 4,805,271

[45] Date of Patent: Feb. 21, 1989

[54] EXPANSIBLE WATCH BAND END CONNECTOR

[75] Inventor: Richard E. Ripley, Attleboro, Mass.

[73] Assignee: Textron, Inc., Providence, R.I.

[21] Appl. No.: 164,093

[22] Filed: Mar. 4, 1988

[51] Int. Cl.[4] ..... A44C 5/18

[52] U.S. Cl. ..... 24/265 WS; 24/71 J; 224/164

[58] Field of Search ..... 24/265 WS, 71 J, 70 J, 24/629, 644, 585; 224/164

[56] References Cited

U.S. PATENT DOCUMENTS

| | | | |
|---|---|---|---|
| 3,976,233 | 8/1976 | Cobelli | 224/164 |
| 4,058,972 | 11/1977 | Weick | 224/164 |
| 4,375,713 | 3/1983 | Bert et al. | 224/164 |
| 4,389,006 | 6/1983 | Nagata | 224/164 |
| 4,432,476 | 2/1984 | Yokosuka | 224/164 |
| 4,605,312 | 8/1986 | Sellier | 24/265 WS |
| 4,653,933 | 3/1987 | Reichel | 224/164 |

*Primary Examiner*—Victor N. Sakran

*Attorney, Agent, or Firm*—Samuels, Gauthier, Stevens & Kehoe

[57] ABSTRACT

An end connector for connecting an end of a watch band to a watch case. The watch case has spaced lugs adapted to accommodate a conventional spring bar or the like removably engaged therebetween. The watch band is of the expansible type with a row of top links overlying a row of bottom links, and with spring loaded elements for interconnecting the top and bottom links in a manner permitting longitudinal expansion and contraction of the band. The end connector comprises a generally flat shank having a hook portion at one end and a tab portion at an opposite end. The shank is configured and dimensioned for insertion into the end of the watch band between the rows of top and bottom links. The tab portion is bent out of the plane of the thus inserted shank into an interlocked position protruding between two adjacent bottom links, and the hook portion is engaged with the spring bar. The arrangement of the hook portion in relation to the shank is such that the endmost top link of the band is used against the watch case to provide a continuous integral look therebetween.

6 Claims, 2 Drawing Sheets

EXPANSIBLE WATCH BAND END CONNECTOR

BACKGROUND OF THE INVENTION

1. Field of the Invention

This invention relates to end connectors for attaching the ends of expansible watch bands to watch cases of the type having spaced lugs with removable spring bars or the like extending therebetween.

2. Description of the Prior Art

Referring initially to FIGS. 1–4, it will be seen that in the known combination of an expansible watch band 10 and a watch 12, the watch case 14 has oppositely extending pairs of lugs 16 with spring bars 18 or the like removably positioned therebetween.

The design of the spring bars 18 is well known to those skilled in the art, and thus a detailed description thereof is unnecessary, except to note that each bar includes a tubular barrel 20, with pintles 22 telescopically received in the ends thereof, and with spring means (not shown) contained in the barrel for resiliently urging the pintles outwardly. The spring bars are adapted to be removably positioned between the pairs of lugs 16, with the pintles 22 snapped into engagement in aligned passages or apertures 24 in the lugs.

The construction of the band 10 is also well known to those skilled in the art. Typically, the band includes a row of top links 26 made up of box-like interiors **26*a* covered by decorative top shells 26*b*, and a row of box-like bottom links 28. The top links 26 overlie and are staggered in relation to the bottom links 28, with means including U-shaped staples 30 and leaf springs 32** for interconnecting the top and bottom links in a manner permitting resilient longitudinal expansion and contraction of the band.

The box-like top and bottom elements **26*b*, 28 and the associated staples 30 and springs 32 make up a standard skeleton structure whose appearance can be varied widely by employing differently designed top shells 26*a*. Often, as illustrated in FIGS. 1 and 2**, the top shells will have a highly decorative and attractive interlocking relationship.

The ends of the band 10 are connected to the watch case 14 by means of end connectors 34 which typically include a flat shank 36 having a hook portion 38 at one end and a tab portion 40 at the opposite end. The tab portion is initially formed in a coplanar relationship with the shank 36, and the shank is configured and dimensioned to be received in the end of the band between the rows of top and bottom links 26,28. The tab portion 40 is then bent out of the plane of the shank into an interlocked position protruding between a pair of adjacent bottom links 28, as illustrated in FIG. 2. The endmost upper link 26 is thus urged against the hook portion 38 which protrudes upwardly above the plane of the shank 36 to thereby provide a finished end to the band 10.

During assembly, the spring bar 18 is first inserted into the hook portion 38, as indicated diagrammatically by the arrow 46 in FIG. 1. Then, as shown in FIG. 4, the band is angled with respect to the watch case in order to locate one of the pintles 22 in one of the receiving apertures 24. Finally, a tool 44 is employed to depress the other pintle 22 sufficiently to clear the other lug 16 and thereby allow the band to be rotated into alignment with the watch case, with the other pintle eventually snapping into engagement with its associated aperture 24.

The above-described arrangement is in widespread use, and is considered to be generally acceptable for many applications. Nevertheless, there remain certain drawbacks which contribute unnecessarily to the overall cost of the band, and which detract from the appearance of the finished product, particularly where the designer's objective is to provide an integral or continuous look at the juncture of the band with the watch case.

More particularly, and from the standpoint of economics, because the hook portion 38 of the end connector protrudes above the plane of the shank 36 to thereby provide a visible continuation of the band, the end connector must be specially designed to compliment the design of the top shells **26*a***. Thus, there must be a specially designed end connector for each top shell design. This increases manufacturing, inventory and assembly costs.

From the standpoint of appearance, although the endmost top link 26 is pulled against the hook portion 38 as at 46, there remains a gap 48 between the hook portion and the watch case, as well as gaps 50 on either side of the end connector between the endmost top link and the watch case. In many cases, the gaps 48,50 are accentuated as a result of pivotal movement of the end connector 34 and the endmost top link 26 about the axis of the spring bar 18. Also, the spacing between the lugs 16 must be increased in order to accommodate angling of the band and end connector during assembly, as illustrated in FIG. 4. This results in further gaps 52 between the lugs 16 and the end connector. The gaps 48, 50 and 52 are unsightly, and detract from the overall appearance of the finished product, particularly in cases where an integral or continuous look is being sought between the band and the watch case.

SUMMARY OF THE INVENTION

It is, therefore, a general object of the present invention to provide an improved end connector which eliminates or at least substantially minimizes the above-described problems and drawbacks associated with the prior art end connector.

Another and more specific object of the present invention is to provide an end connector having a hook portion arranged in a manner such that the endmost top link of the band is positioned against the watch case, without unsightly gaps therebetween.

A further object of the present invention is to provide an end connector which is completely hidden from view, thus eliminating any need to conform the design of the end connector to that of the decorative top shells on the band.

Another object of the present invention is to provide an end connector which is restrained against pivotal motion in relation to the watch case, and which thus provides a means of also restraining at least the endmost top link.

These and other objects and advantages of the present invention will become more apparent as the description proceeds with further reference to the accompanying drawing, wherein:

DETAILED DESCRIPTION OF PREFERRED EMBODIMENT

Figure 1:
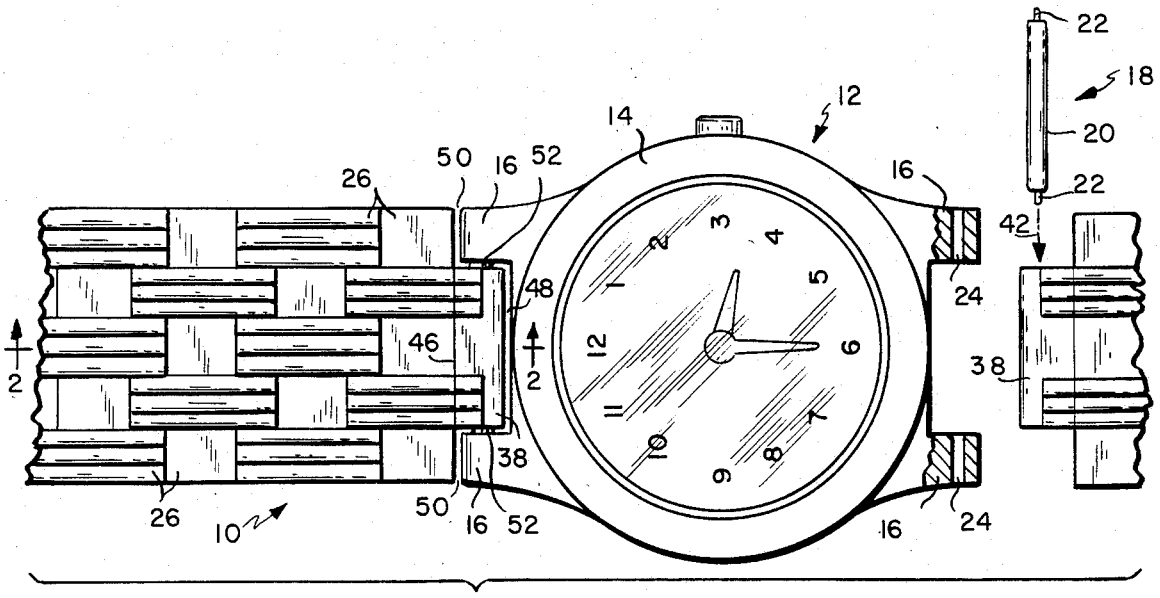
FIG. 1 PRIOR ART
FIG. 1 is a top plan view of a prior art band and watch combination, with parts thereof partially broken away and disassembled.
Figure 2:
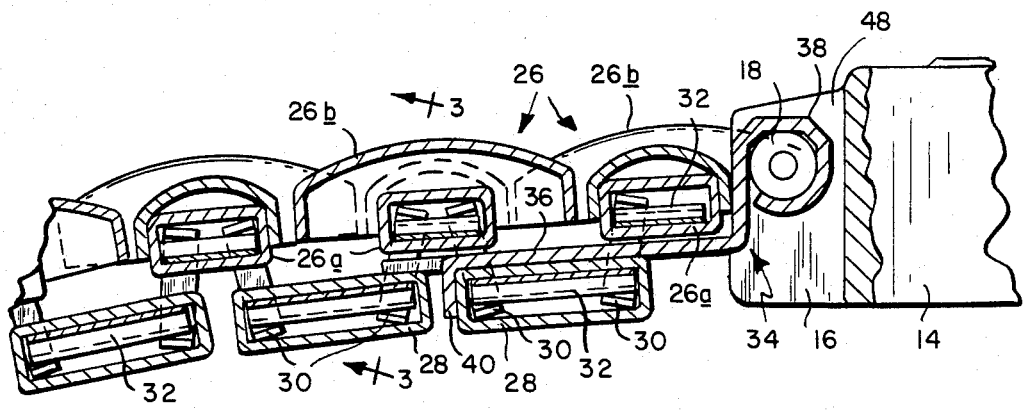
FIG. 2 PRIOR ART
FIG. 2 is a sectional view on an enlarged scale taken along line 2—2 of FIG. 1.
Figure 3:
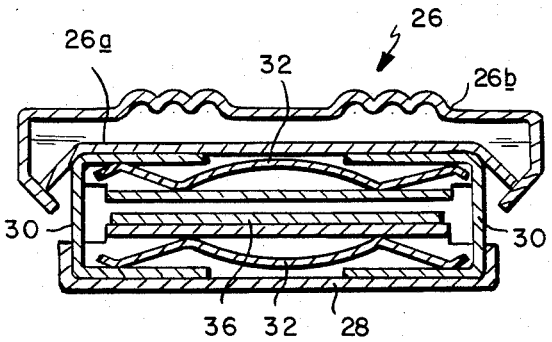
FIG. 3 PRIOR ART
FIG. 3 is a sectional view taken along line 3—3 of FIG. 2.

Referring now to FIGS. 5–8, where the same or substantially identical components of the expansible band, the watch and the spring bar have been identified by the same reference numerals, it will be seen that the end connector 60 of the present invention is again provided with a substantially flat shank 62 received in the end of the band between top and bottom links 26,28. The shank 62 is provided at one end with a hook portion 64, and at the opposite end with a tab portion 66 which is bent out of the plane of the thus inserted shank into an interlocked position protruding between two adjacent bottom links 28. In contrast to the prior art hook connector 34, however, the hook portion 64 of the present invention is located almost entirely below the plane of the shank 62 and is configured to only partially surround the spring bar 18 in engagement therewith, with the spring bar 18 also being located below the plane of the shank at the level of the row of bottom links 28. The hook portion 64 is thus at least partially overlapped by the endmost top link 26.

The distance between the thus bent and engaged tab portion 66 and the thus engaged hook portion 64 is such that the endmost top link 26 is drawn in the direction of arrow 68 (see FIG. 5) over the hook portion 64 and against the watch case 14, the latter having a protrusion 70 between the lugs 16 which coacts with the lateral protrusions and notches in the endmost top link 26 to provide an interlocked relationship matching that of the remainder of the top links of the band. Because the endmost top link is drawn against the watch case as at 72, there are no unsightly gaps at these locations.

The hook portion 64 is additionally provided with reinforcing ridges 74 and a second forwardly bent tab portion 76. The second tab portion 76 engages the underside of the watch case 14, and coacts with the engagement between the case and the endmost top link as at 72 to oppose rotation of the end connector about the axis of the spring bar. The endmost top link 26 is thus also fixed against rotation. This maintains the abutting relationship as at 72 between the endmost top link and the watch case, and thus avoids the development of unsightly gaps.

Figure 4:
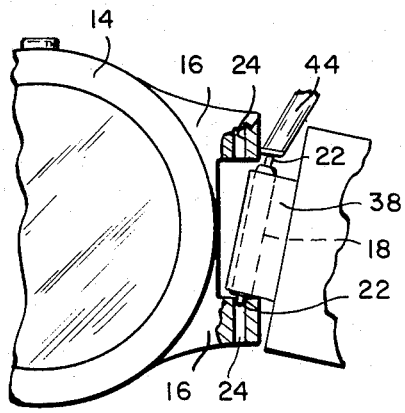
FIG. 4 PRIOR ART
FIG. 4 is a somewhat schematic illustration depicting the manner of assembling the prior art components.
Figure 5:
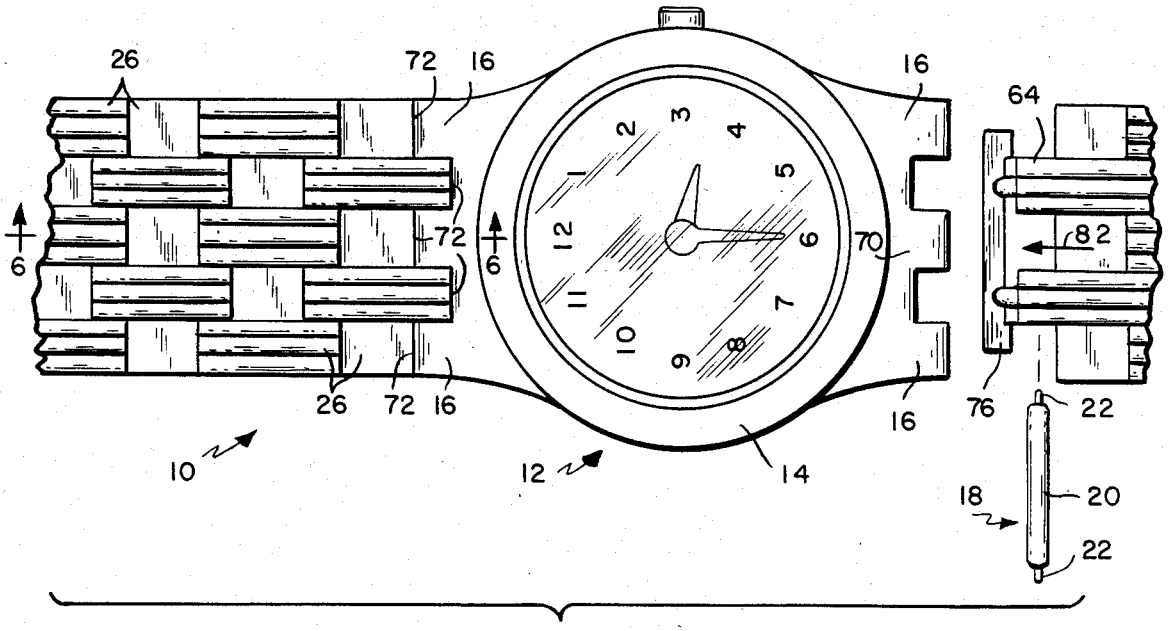
FIG. 5 a top plan view similar to FIG. 1 showing a band and watch combination in accordance with the present invention.
Figure 6:
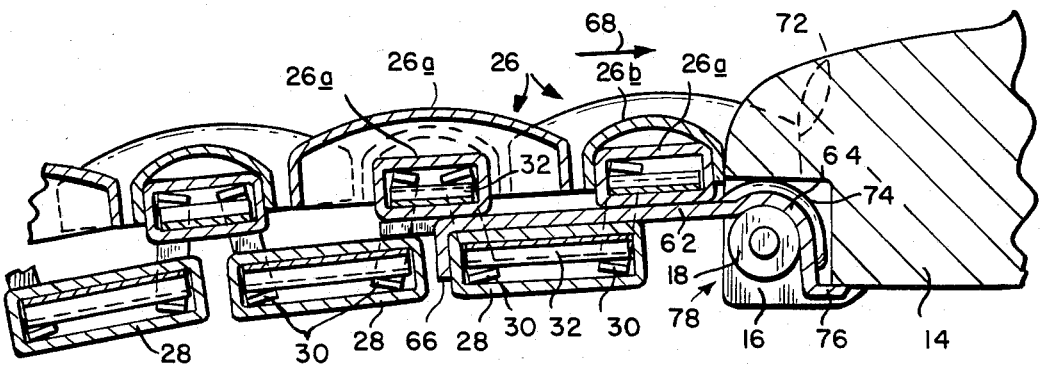
FIG. 6 is a sectional view on an enlarged scale taken along 6—6 of FIG. 5.
Figure 7:
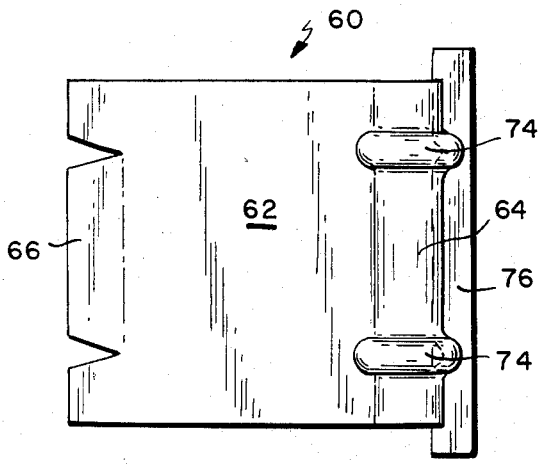
FIG. 7 is a top plan view of the end connector of the present invention.
Figure 8:
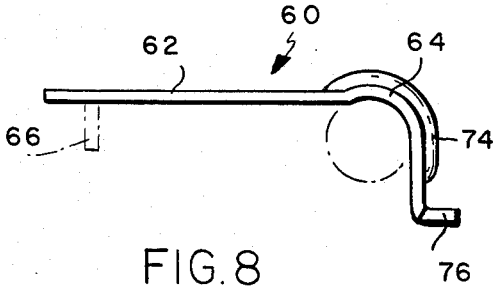
FIG. 8 is a side view of the end connector shown in FIG. 7.

Because the hook portion 64 only partially surrounds the spring bar 18, there remains a downwardly facing opening 78 through which access can be had to the spring bar during assembly of the band to the watch case. This is highly advantageous, particularly in situations where, as herein illustrated, the watch case has one or more protrusions 70 between the support lugs 16 which are intended to interlock with recesses in the endmost top link. Because of the access provided by the downwardly facing opening 78, positioning and engagement of the spring bar 18 can be delayed until after the band is brought against the watch case in the direction indicated by arrow 82 in FIG. 5. Thereafter, the spring bar is inserted into its engaged position via opening 78, which provides full access to both pintles 22. By virtue of the fact that the band is brought against the case longitudinally in the direction of arrow 82, rather than angularly or pivotally as shown in FIG. 4, a very tight fit can be provided between the side faces of the lugs 16 and protrusion 70 on the watch case and the complimentary side faces on the lateral interlocking protrusions of the endmost top link 26. The net result, as illustrated on the left hand side of FIG. 5, is an integral continuous look between the band and the watch case, without unsightly gaps, and with the end connector completely hidden from view beneath the interlocking portions of the endmost top link and the watch case.

In light of the foregoing, it will be appreciated by those skilled in the art that the present invention can also be employed with non-interlocking bands, and that the watch lugs may protrude downwardly from apron portions of the case rather than laterally as herein illustrated.

I claim:

1. An end connector for connecting an end of a watch band to a watch case, the watch case having spaced lugs adapted to accommodate to conventional spring bar or the like removably engaged therebetween, and the watch band being of the expansible type with a row of top links overlying a row of bottom links, and with means for interconnecting the top and bottom links in a manner permitting longitudinal expansion and contraction of the band, said end connector comprising: a generally flat shank having an arcuate hook portion integrally formed at one end and protruding out of the plane of said shank to one side thereof, a tab portion at an opposite end of said shank, said shank being configured and dimensioned for insertion into the end of the watch band between the rows of top and bottom links, said tab portion being bent to protrude out of the plane of the thus inserted shank to the same one side thereof and into an interlocked position between two adjacent links in one of said rows, said hook portion being engaged with the spring bar, the distance between the thus engaged hook portion and the thus bent tab portion being such that the endmost top link of the band is urged against the watch case, and wherein said hook portion is at least partially overlapped by the endmost top link of the band.

2. The end connector of claim 1 wherein the endmost top link of the band and the watch case are configured to interlock one with the other, and wherein said hook portion is overlapped by and hidden from view under the interlocked portions of the endmost top link and watch case.

3. The end connector of claim 1 wherein said hook portion is engageable with the watch case in a manner cooperating with the contact of the endmost top link with the watch case to oppose rotation of said end connector relative to the watch case about the axis of the spring bar.

4. The end connector of claim 3 wherein at least the endmost top link of the band is fixed relative to the watch case.

5. The end connector claim 1 wherein the thus bent tab portion protrudes between two adjacent bottom links.

6. The end connector of claim 1 wherein the thus engaged hook portion partially surrounds the spring bar in a manner permitting access to the spring bar from beneath said end connector.

* * * * *